US008393191B2

(12) United States Patent
Itaya

(10) Patent No.: US 8,393,191 B2
(45) Date of Patent: Mar. 12, 2013

(54) WIRE FORMING APPARATUS

(75) Inventor: Ichiro Itaya, Matsudo (JP)

(73) Assignee: Kabushiki Kaisha Itaya Seisaku Sho, Matsudo-shi, Chiba-ken (JP)

( * ) Notice: Subject to any disclaimer, the term of this patent is extended or adjusted under 35 U.S.C. 154(b) by 374 days.

(21) Appl. No.: 12/816,110

(22) Filed: Jun. 15, 2010

(65) Prior Publication Data

US 2011/0005633 A1 Jan. 13, 2011

(30) Foreign Application Priority Data

Jul. 8, 2009 (JP) ..... 2009-162177

(51) Int. Cl.
*B21F 3/04* (2006.01)

(52) U.S. Cl. ..... 72/135; 72/145

(58) Field of Classification Search ..... 72/135, 72/138, 140, 142–145, 441, 442, 446, 447, 72/454

See application file for complete search history.

(56) References Cited

U.S. PATENT DOCUMENTS

| | | | |
|---|---|---|---|
| 5,937,685 A | 8/1999 | Matsuoka et al. | |
| 6,142,002 A | 11/2000 | Itaya | |
| 6,151,942 A * | 11/2000 | Itaya | 72/137 |

FOREIGN PATENT DOCUMENTS

| | | |
|---|---|---|
| DE | 199 38 905 A1 | 3/2000 |
| JP | 10-29028 | 2/1998 |
| JP | 3026793 | 2/2000 |
| JP | 2000-343166 | 12/2000 |
| JP | 2008-126287 | 6/2008 |

OTHER PUBLICATIONS

German Office Action for German patent application No. 10 2010 017462.9 mailed Apr. 25, 2012 (English Translation).

Office Action for priority Japanese patent application No. 2009-162177 mailed Apr. 15, 2011 (No English translation).

* cited by examiner

*Primary Examiner* — Debra Sullivan

(74) *Attorney, Agent, or Firm* — Merchant & Gould P.C.

(57) ABSTRACT

A wire forming apparatus which feeds out a wire (W) from a distal end portion of a wire guide (402), forcibly bends, curves, or winds the wire by using a forming tool (T1-T5) and forms the wire into a part with a desired shape by using a cutting tool (T0), wherein the forming tool includes a coiling tool of which a coiling spindle rotates about its central axis, a coiling tool unit (T1, T2) which rotatably supports the coiling tool and a cutting tool unit (T0) which supports a cutting blade (506) and a receiving portion (507) constituting the cutting tool so as to allow the cutting blade and the receiving portion to relatively reciprocate are attached to the tool selection table (210), and a common driving source is provided to apply driving force to the coiling tool unit and the cutting tool unit attached on the tool selection table.

4 Claims, 15 Drawing Sheets

WIRE FORMING APPARATUS

CROSS-REFERENCE TO RELATED APPLICATION

This application is entitled to the benefits of Japanese Patent Application No. 2009-162177, filed Jul. 8, 2009.

BACKGROUND OF THE INVENTION

1. Field of the Invention

The present invention relates to a wire forming apparatus which forms parts having various shapes by, for example, forcibly bending, curving, or winding a wire using a forming tool while feeding the wire, and cutting it with a cutting tool.

2. Description of the Related Art

For example, Japanese Patent No. 3026793 discloses a spring manufacturing apparatus which allows selection of an arbitrary tool by rotating a tool selection table radially supporting a plurality of types of forming tools (other than cutting tools).

According to Japanese Patent No. 3026793, however, cutting tools cannot be mounted on the tool selection table and hence are slidably mounted on auxiliary tool apparatus 450 and 460 separately fixed on a base. This therefore makes it necessary to cut a wire always at the same position, resulting in limiting the degree of freedom in machining.

In the prior art, a cutting tool Ta is made to slide downward relative to the distal end portion of a wire guide 415, from which a wire is fed, to produce shearing force in cooperation with the wire guide 415, thereby cutting the wire. When cutting a wire having a diameter of 5 mm or more, the wire guide may be deformed or damaged by the shearing force required to cut the wire.

SUMMARY OF THE INVENTION

The present invention has been made in consideration of the above problem and realizes a wire forming apparatus which can improve the degree of freedom in selecting a wire cutting process and cutting portion in the process of formation.

In order to solve the above problem, according to the present invention, there is provided a wire forming apparatus which feeds out a wire (W) from a distal end portion of a wire guide (402), forcibly bends, curves, or winds the wire by using a forming tool (T1-T5) and forms the wire into a part with a desired shape by using a cutting tool (T0), wherein the forming tool includes a coiling tool of which a coiling spindle rotates about its central axis, a coiling tool unit (T1, T2) which rotatably supports the coiling tool and a cutting tool unit (T0) which supports a cutting blade (506) and a receiving portion (507) constituting the cutting tool so as to allow the cutting blade and the receiving portion to relatively reciprocate are attached to the tool selection table (210), and a common driving source is provided to apply driving force to the coiling tool unit and the cutting tool unit attached on the tool selection table.

According to the present invention, it is possible to improve the degree of freedom in selecting a wire cutting process and cutting portion in the process of formation.

Other scopes and advantage besides those discussed above shall be apparent to those skilled in the art from the description of an embodiment of the invention as follows. In the description, reference is made to accompanying drawings, which form apart thereof, and which illustrate an example of the invention. Such example, however, is not exhaustive of the various embodiments of the invention, and therefore reference is made to the claims which follow the description for determining the scope of the invention.

DESCRIPTION OF THE EMBODIMENTS

An embodiment of the present invention will be described in detail below with reference to the accompanying drawings. Although the following description is an example in which a wire forming apparatus of the present invention is applied to a spring manufacturing apparatus, which forms a wire into a spring in a desired shape, the wire forming apparatus can be applied to apparatus that form parts other than springs.

[Overall Arrangement of Spring Manufacturing Apparatus]

Figure 1:
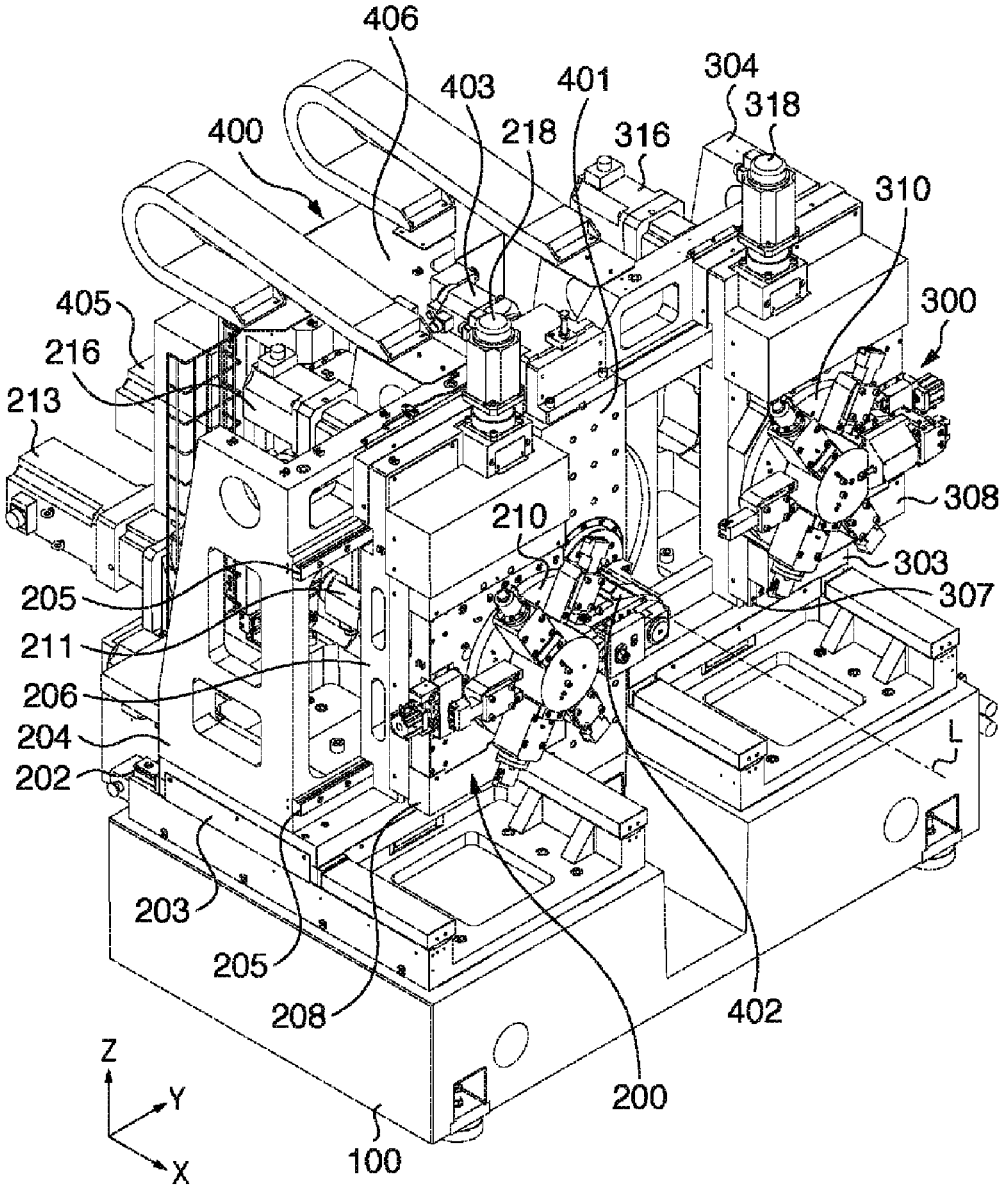
FIG. 1 is an external perspective view of a spring manufacturing apparatus according to an embodiment of the present invention.
Figure 2:
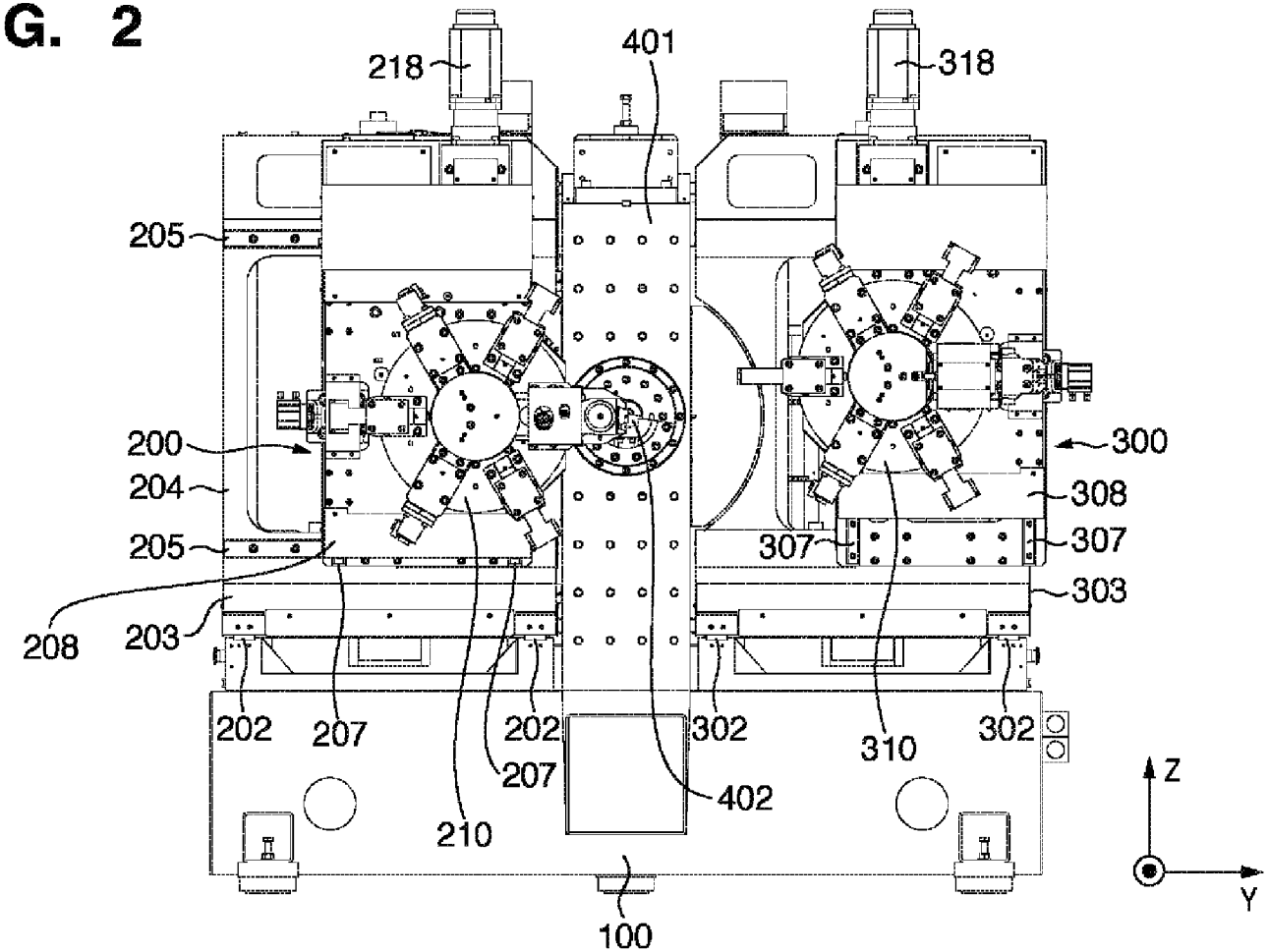
FIG. 2 is a front view of FIG. 1.
Figure 3:
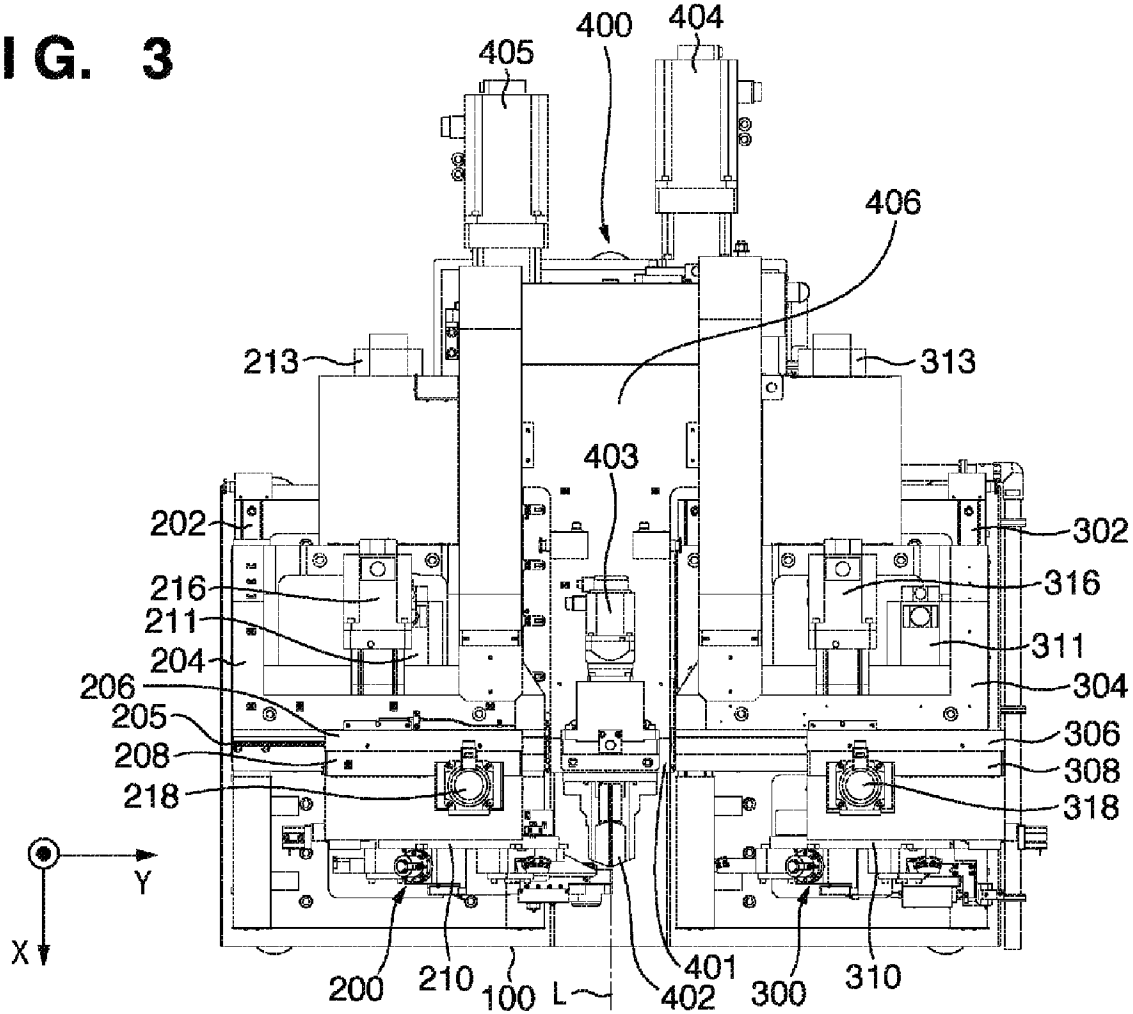
FIG. 3 is a plan view of FIG. 1.

FIG. 1 is an external perspective view of a spring manufacturing apparatus according to an embodiment of the present invention. FIG. 2 is a front view of FIG. 1. FIG. 3 is a plan view of FIG. 1.

As shown in FIGS. 1 to 3, the spring manufacturing apparatus according to this embodiment includes a box-like base 100, first and second tool selection devices 200 and 300 attached to the upper end face of the base 100, a wire feed device 400 placed between the first and second tool selection devices 200 and 300, and a controller (to be described later with reference to FIG. 15) to comprehensively control the respective devices.

The first and second tool selection devices 200 and 300 are symmetrically arranged about the wire feed device 400, and allow to select desired tools for a spring forming space by circumferentially rotating first and second tool selection tables 210 and 310 which support a plurality of forming tools which operate differently and one cutting tool (the forming tools and the cutting tool may be generically referred to as tools hereinafter).

The wire feed device 400 includes a frame 401 extending upward from the base 100, and axially supports at least one pair of upper and lower feed rollers (not shown because they are located below a cover 406), which clamp a wire, so as to allow them to pivot around a wire axis L. The frame 401 axially supports a wire guide 402 near the middle portion of the frame 401 in the vertical direction so as to allow it to pivot around the wire axis L. The wire guide 402 feeds out the wire, fed out from the wire feed device 400 along the wire axis L, from the distal end portion while guiding the wire toward the spring forming space.

The wire guide 402 is made to pivot to change the spring forming space by changing the space on the inclined surface side of the wire guide 402, thereby forming a spring in a desired shape regardless of the positions of tools. A feed roller driving motor 404 rotates/drives the feed rollers in a direction to feed out a wire. A feed roller rolling motor 405 rotates/drives the feed rollers around the wire axis L so as to twist a wire while clamping it.

The space defined by the wire guide 402 and the tools moved to working positions by the first and second tool selection devices 200 and 300 serves as a spring forming space.

[Arrangement of Tool Selection Device]

The tool selection devices mounted on the spring manufacturing apparatus according to this embodiment will be described next. Since the first tool selection device 200 and the second tool selection device 300 have almost symmetrical structures, only the arrangement of the first tool selection device 200 will be described below. Referring to FIGS. 1 to 3, therefore, the components of the second tool selection device 300 (some of which are not shown) are comprehended by replacing the reference numerals of the respective components of the first tool selection device 200 with numbers in the 300s.

Figure 4:
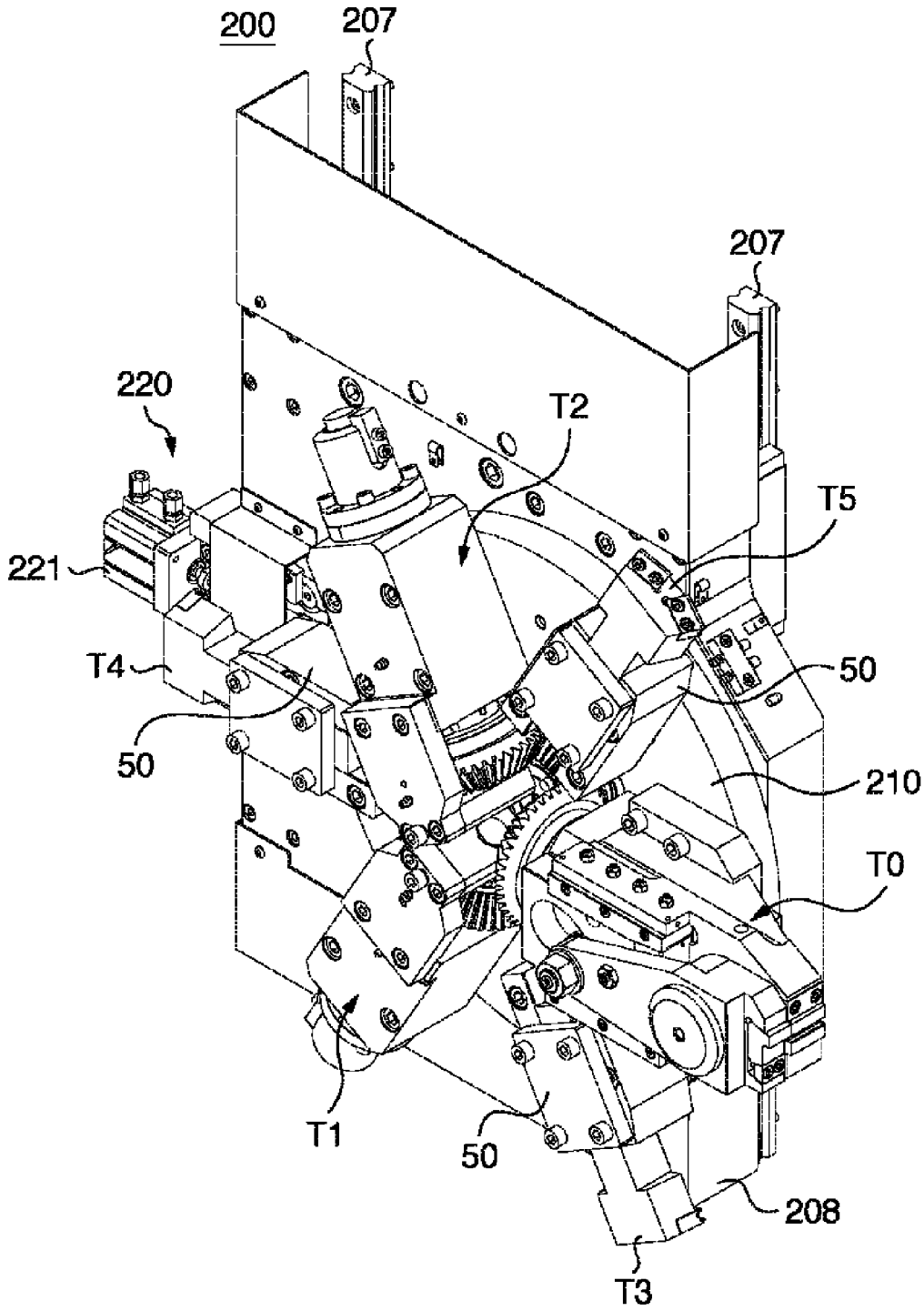
FIG. 4 is a perspective view of a tool selection device extracted from FIG. 1.
Figure 5:
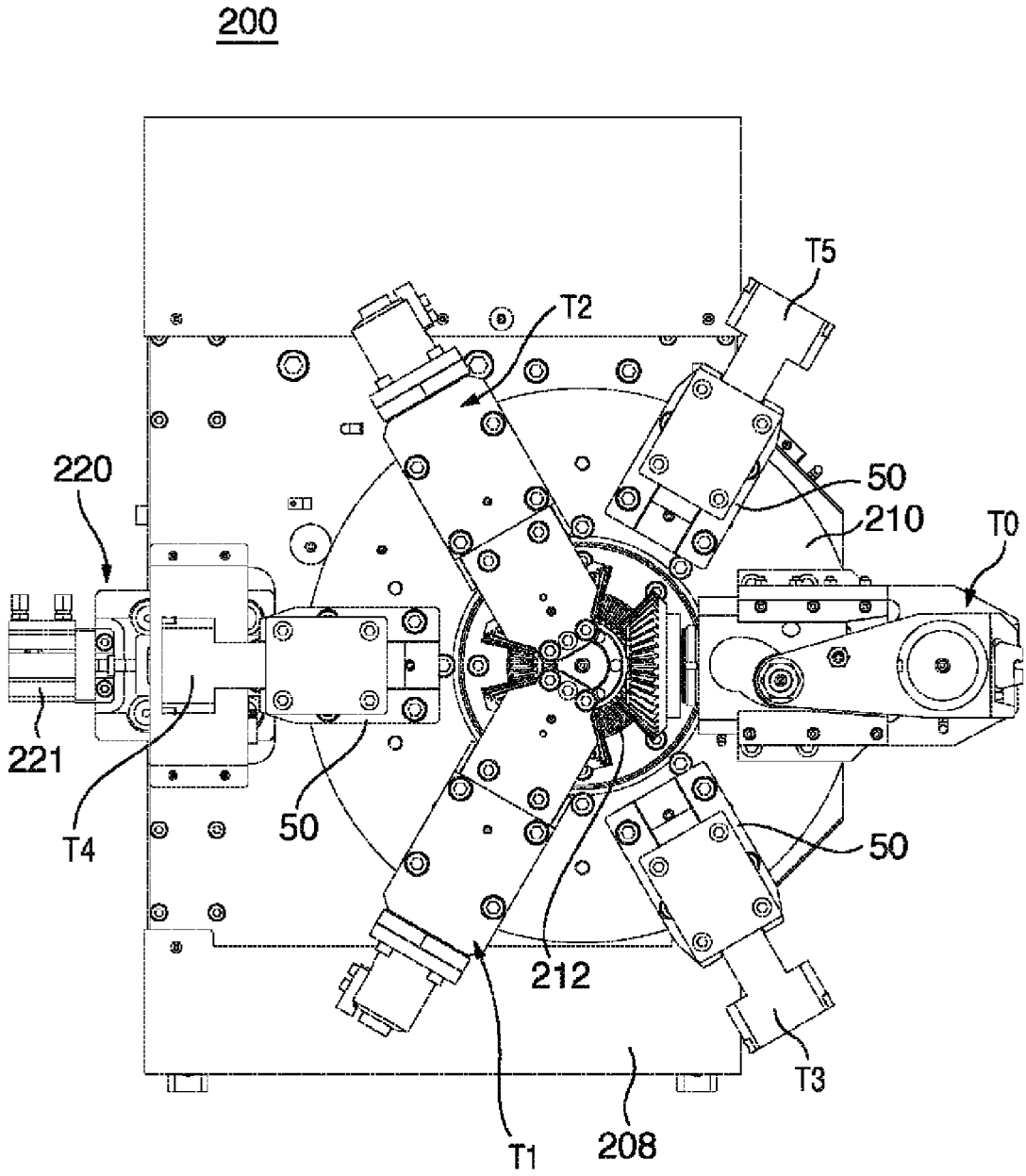
FIG. 5 is a front view of FIG. 4.
Figure 6:
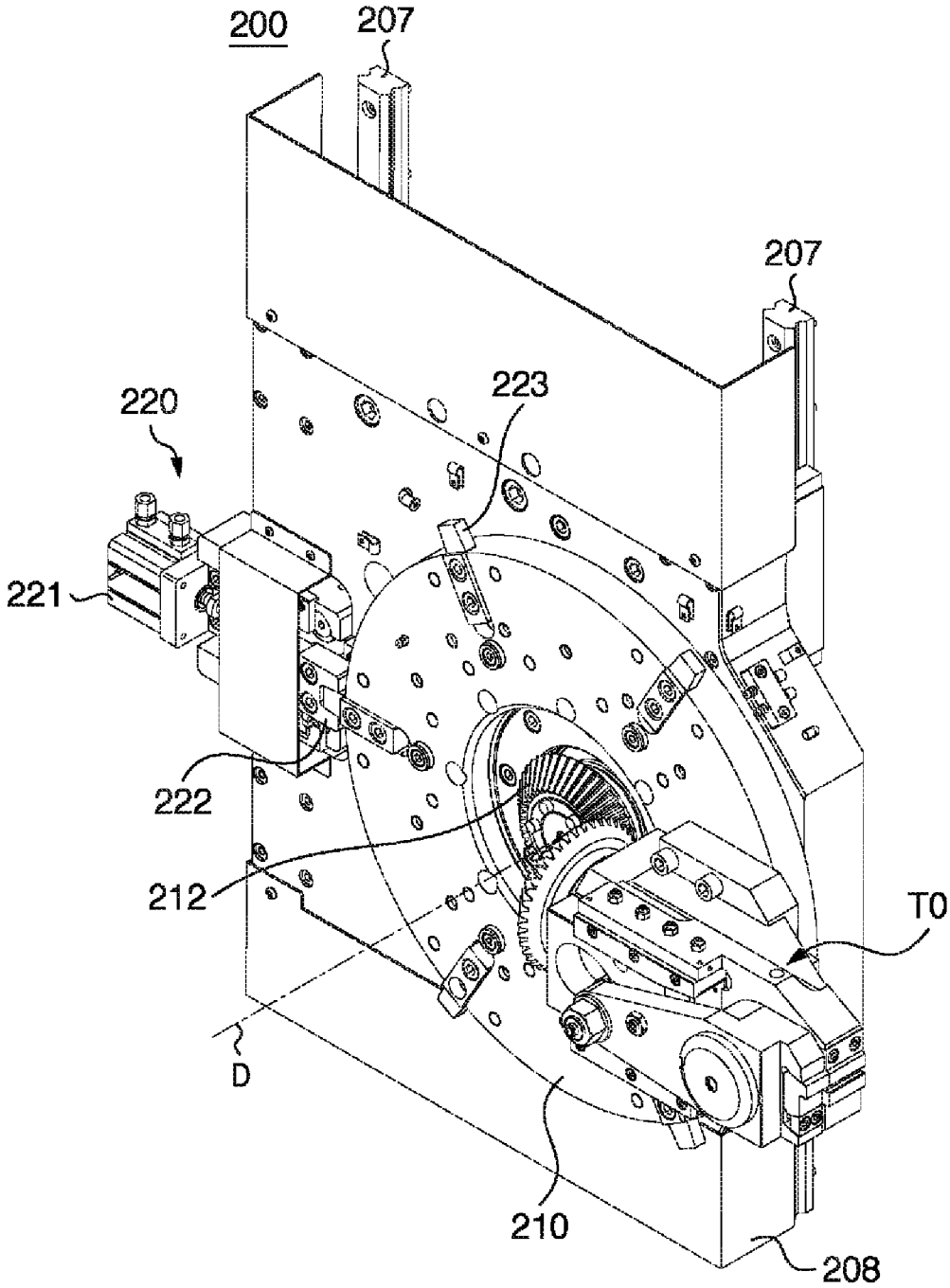
FIG. 6 is a perspective view of the tool selection device from a different direction while only a cutting tool unit is attached to the apparatus.
Figure 7:
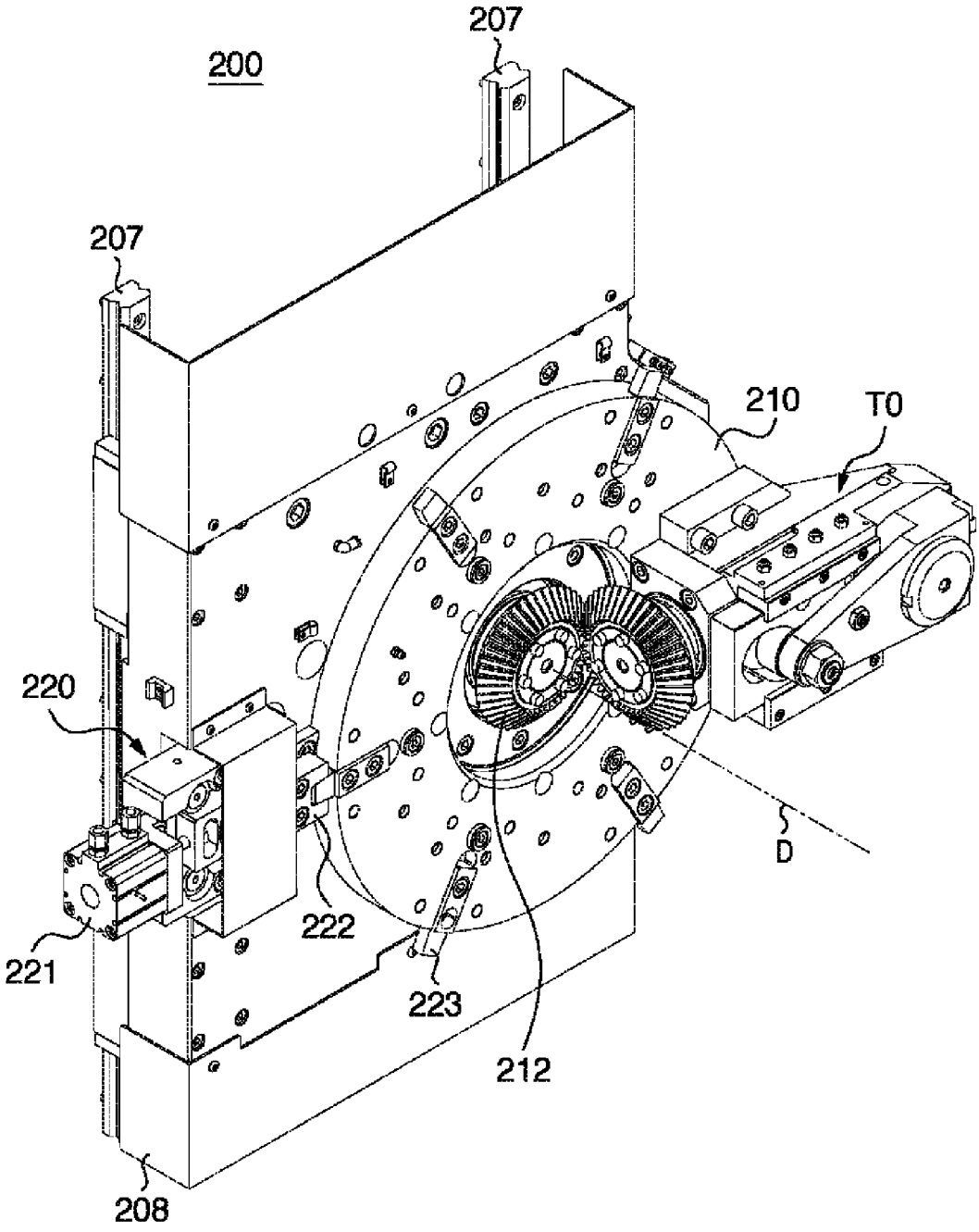
FIG. 7 is a perspective view of the tool selection device from a different direction while only the cutting tool unit is attached to the apparatus.
Figure 8:
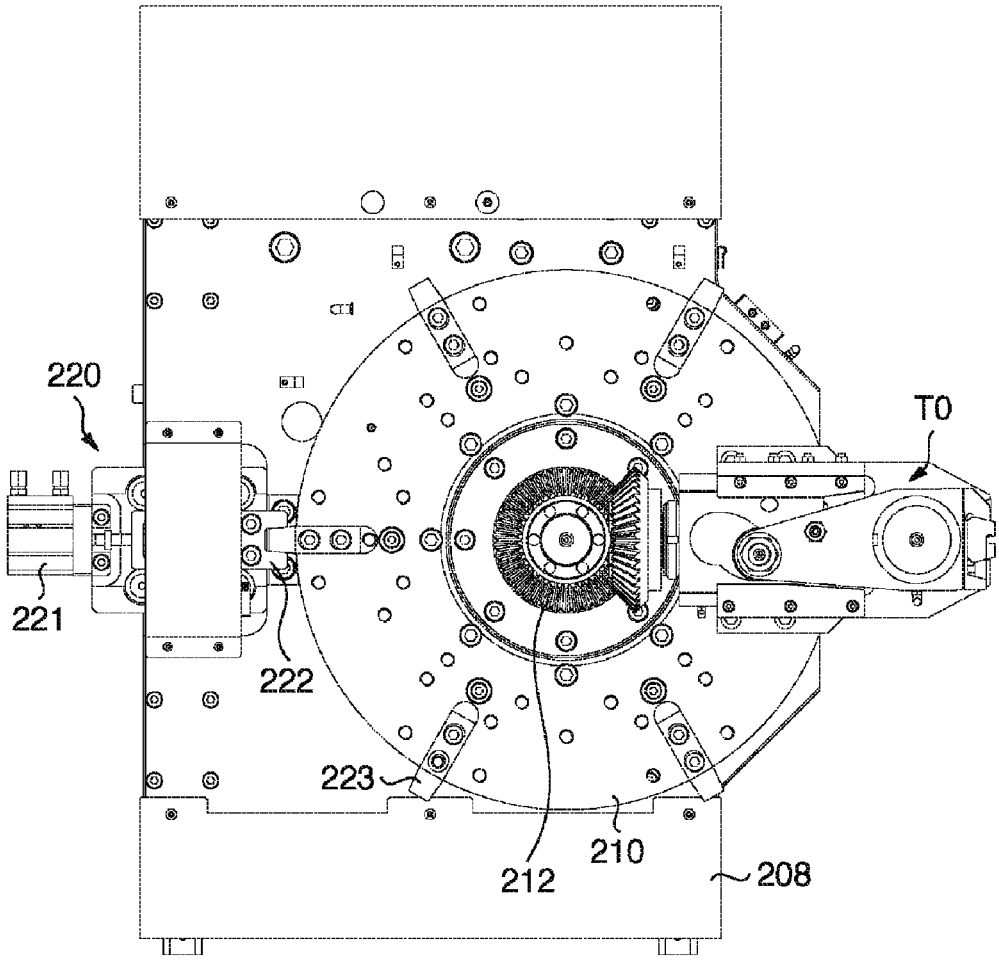
FIG. 8 is a front view of FIG. 6.

FIG. 4 is a perspective view of the tool selection device extracted from FIG. 1. FIG. 5 is a front view of FIG. 4. FIGS. 6 and 7 are perspective views of the tool selection device from different directions while only the cutting tool unit is attached to the apparatus. FIG. 8 is a front view of FIG. 6.

As shown in FIGS. 4 to 8, the first tool selection device 200 includes the disk-like tool selection table 210 which can circumferentially rotate about a driving axis D parallel to the wire axis L. The tool selection table 210 detachably supports a cutting tool and a plurality of types of forming tools which have different distal end shapes and operate differently (slide or rotate) in accordance with various spring dimensions such as a wire diameter and a coil inner diameter. The tool selection table 210 is mounted on a moving table which three-dimensionally moves the tool selection table 210 to move a rotated and selected tool toward the spring forming space and finely adjust the tool position. Note that the driving axis D is not limited to an axis parallel to the wire axis L, and may define a predetermined angle with respect to the wire axis L.

In addition, the first tool selection device 200 is provided with a stopper mechanism 220. The stopper mechanism 220 includes an air cylinder 221 and a stopper 222 which is made to reciprocate by the air cylinder 221. When a recess portion of the stopper 222 engages with one of positioning pins 223 provided on the outer circumferential surface of the tool selection table 210 at positions corresponding to a plurality of tool mount portions, the stopper 222 holds the tool selection table 210 to inhibit it from rotating at a predetermined selection position. Disengaging the positioning pin 223 of the stopper 222 allows the tool selection table 210 to rotate.

As also shown in FIGS. 1 to 3, the moving table includes a back-and-forth moving table 203 which can move in the back-and-forth (X) direction along a back-and-forth rail 202 attached to the upper end face of the base 100, a laterally moving table 206 which can move in the lateral (Y) direction along a lateral rail 205 fixed on the back-and-forth moving table 203 through a frame 204, and a vertically moving table 208 which can move in the vertical (Z) direction along a vertical rail 207 fixed on the laterally moving table 206.

The back-and-forth moving table 203 can be moved along the back-and-forth rail 202 by a feed ball screw mechanism using a back-and-forth driving motor 213 as a driving source. The laterally moving table 206 can be moved along the lateral rail 205 by a feed ball screw mechanism by using a laterally driving motor 216 as a driving source which is provided on the rear surface of the laterally moving table 206. The vertically moving table 208 can be moved along the vertical rail 207 by a feed ball screw mechanism by using a vertically moving motor 218 as a driving source.

The tool selection table 210 can rotate about the driving axis D parallel to the wire axis L by using a table driving motor 211 as a driving source which is mounted on the vertically moving table 208.

A cutting tool unit T0 (to be described later), coiling tool units T1 and T2, and abutment tools T3 to T5 can be attached to the tool selection table 210. In the case shown in the accompanying drawings, one cutting tool unit T0 and the two types of coiling tool units T1 and T2 are arranged at 120° intervals, and the three types of abutment tools T3 to T5 are arranged between them. An operator selects a desired tool by rotating the tool selection table 210. The wire guide 402 can be made to pivot about the wire axis L by a guide driving motor 403 provided on the frame 401.

The abutment tools T3 to T5 include groove portions which abut against the wire fed from the wire guide 402, and perform coiling, bending, and the like of the wire by forcibly curving it in the directions in which the groove portions are formed.

As will be described later, the tool selection table 210 is provided with a bevel gear 212 which rotates about the driving axis D as a common driving source for giving driving force to the respective tool units to drive the cutting tool unit T0 and the coiling tool units T1 and T2.

In this embodiment, the tool selection table 210 supports a plurality of types of tools so as to allow to select one of them by rotating. It is possible to move the tool selection table 210 in three-dimensional directions by numerical control using the moving tables 203, 206, and 208 which can move the tool selection table 210 in the three-dimensional directions. This makes it possible to totally automate the selection of tools, the driving of tools, and the fine adjustment of tool positions by numerical control.

[Arrangement of Cutting Tool Unit]

Figure 9A:
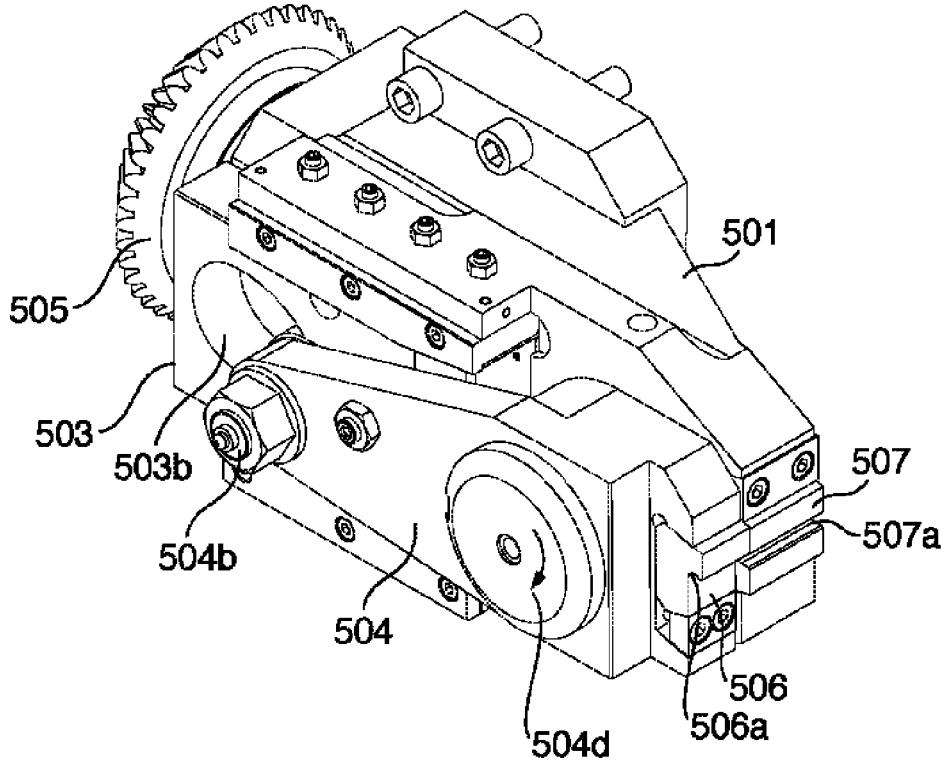
FIGS. 9A and 9B are perspective views of the cutting tool unit according to this embodiment from different directions before cutting operation.
Figure 9B:
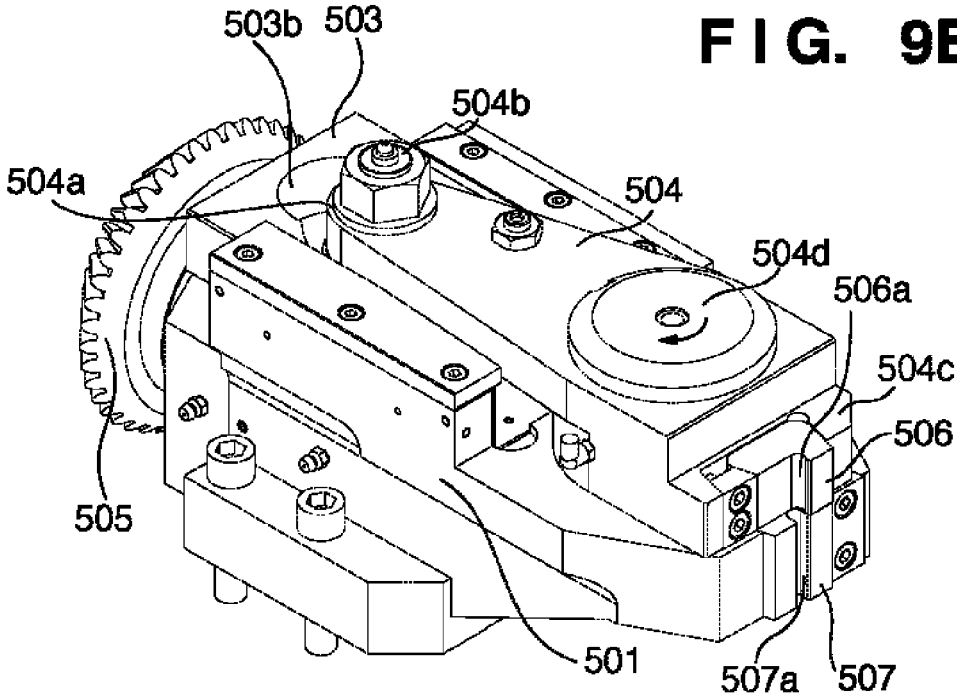
Figure 10A:
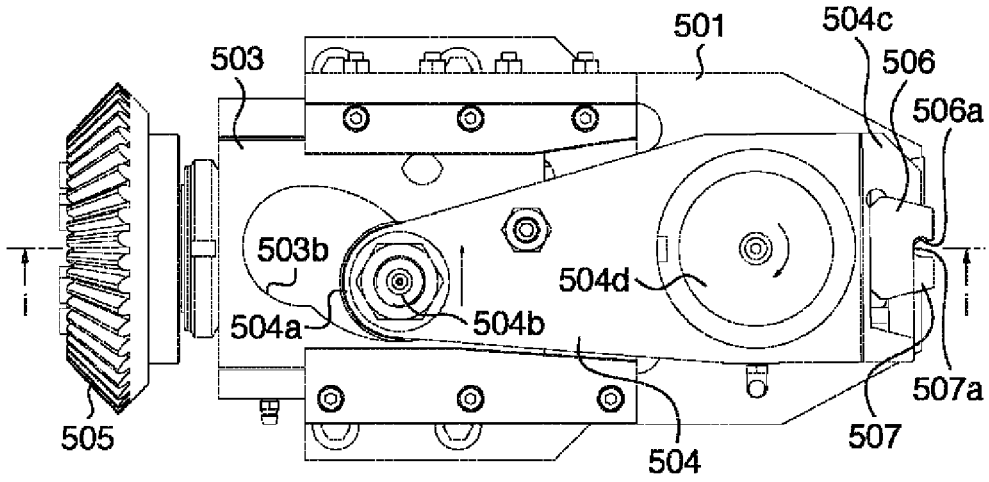
FIG. 10A is a front view of FIG. 9A.
Figure 10B:
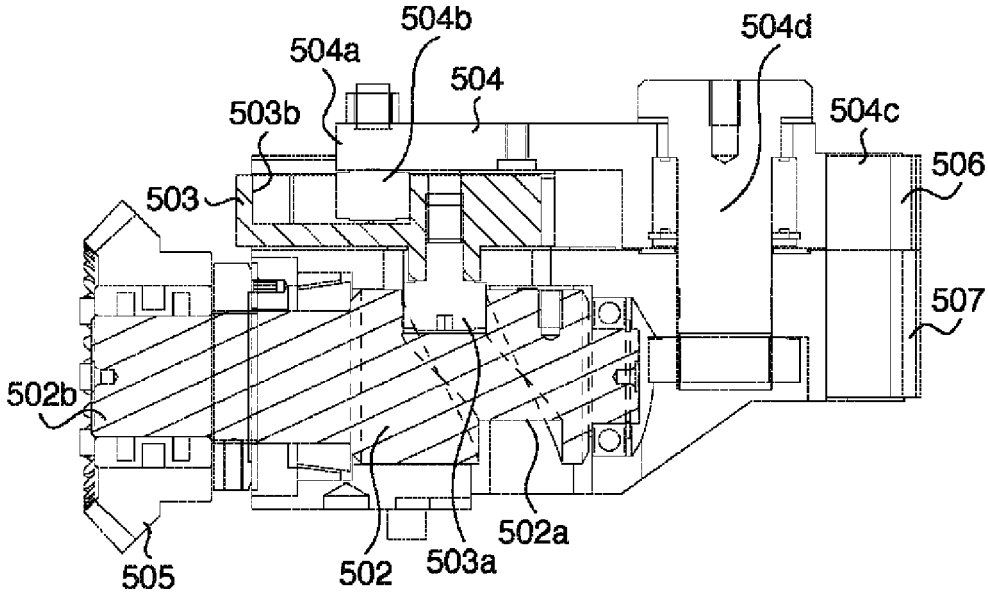
FIG. 10B is a sectional view taken along i-i in FIG. 10A.
Figure 11A:
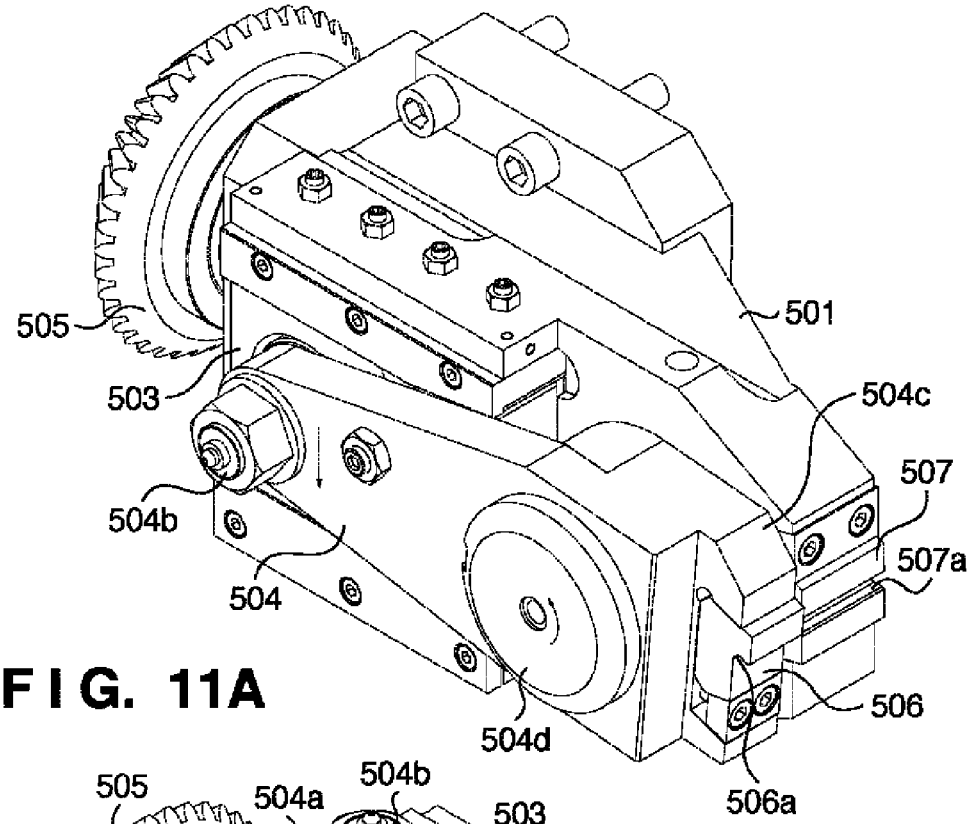
FIGS. 11A and 11B are perspective views of the cutting tool unit in this embodiment from different directions after cutting operation.
Figure 11B:
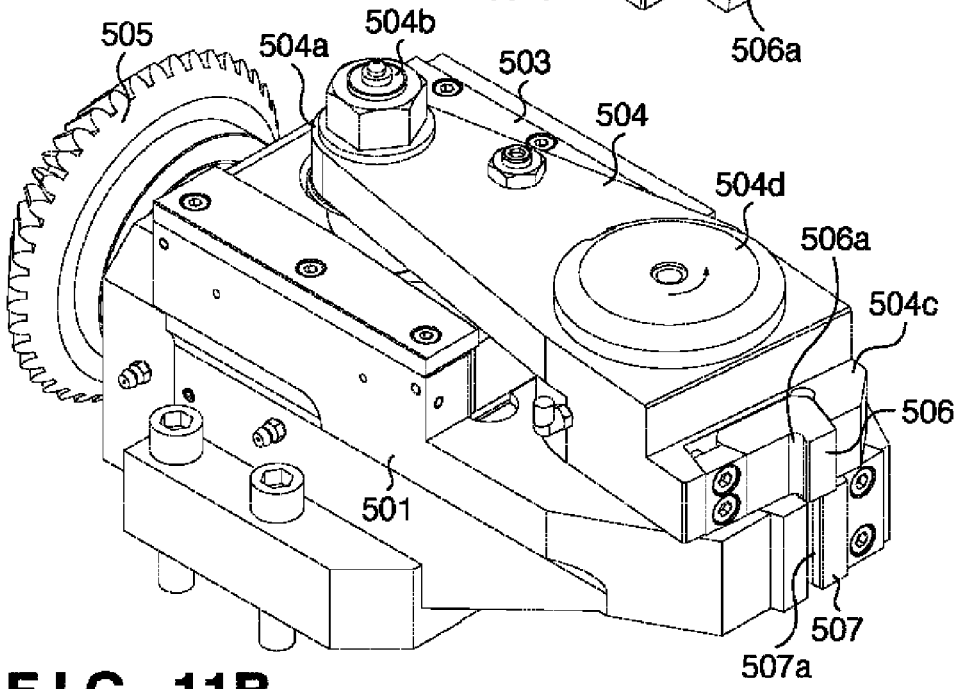
Figure 12A:
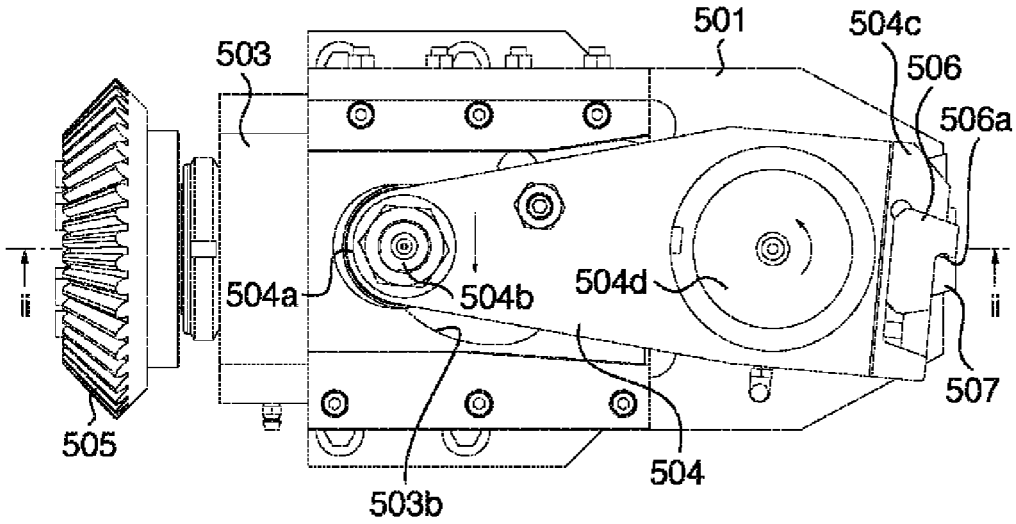
FIGS. 12A and 12B are respectively a front view of FIG. 11A and a sectional view taken along ii-ii in FIG. 12B.
Figure 12B:
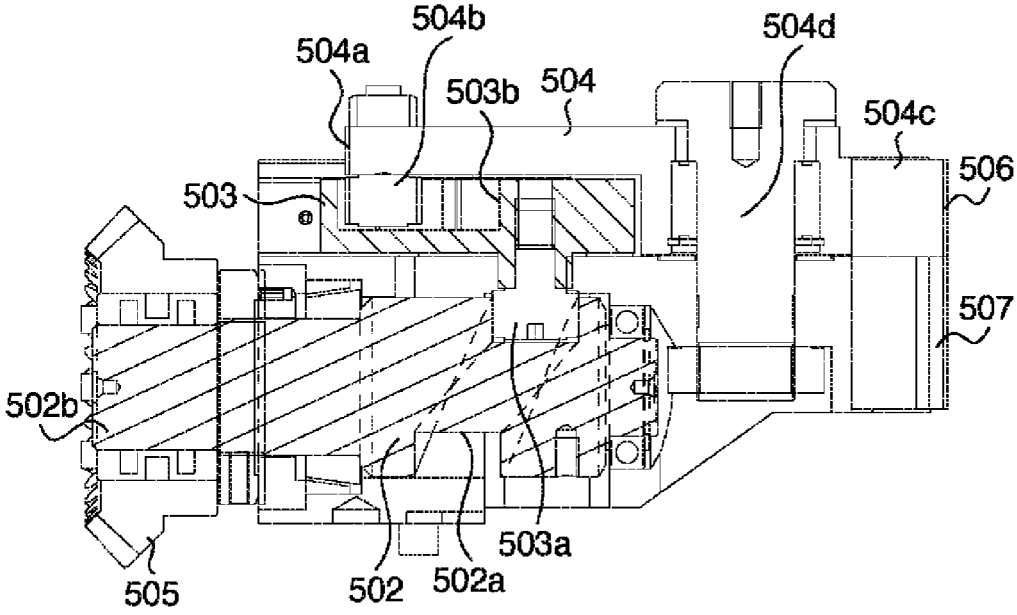

FIGS. 9A and 9B are perspective views of the cutting tool unit in this embodiment from different directions before cutting operation. FIG. 10A is a front view of FIG. 9A. FIG. 10B is a sectional view taken along i-i in FIG. 10A. FIGS. 11A and 11B are perspective views of the cutting tool unit in this embodiment from different directions after cutting operation. FIG. 12A is a front view of FIG. 11A. FIG. 12B is a sectional view taken along ii-ii in FIG. 12A.

As shown in FIGS. 9A to 12B, the cutting tool unit T0 includes a base portion 501 attached to the tool selection table 210, a rotating shaft 502 axially supported on the base portion 501 through a bearing so as to be pivotal, a slider 503 slidably supported on the base portion 501, and an arm portion 504 which is axially supported on the base portion 501 so as to be pivotal and is in slidable contact with the slider 503.

A groove portion 502*a* as a cam profile is formed in the outer circumferential surface of the rotating shaft 502. The groove portion 502*a* is formed to be inclined in the axial direction of the rotating shaft 502 such that the position in the axial direction changes with a change in the rotational angle of the rotating shaft 502 as it rotates. A bevel gear 505 is axially mounted on one end portion 502*b* of the rotating shaft 502, and meshes with the bevel gear 212 which rotates about the driving axis D of the tool selection table 210.

The slider 503 is provided with a protruding portion 503*a* which slidably engages with the groove portion 502*a* of the rotating shaft 502. Making the protruding portion 503*a* slide along the groove portion 502*a* will convert the rotating operation of the rotating shaft 502 into linear operation. The slider 503 has a hole portion 503*b* which extends as a cam profile in the sliding direction and has a step in the vertical direction.

A roller portion 504*b* rolling contact with the hole portion 503*b* is axially supported on one end portion 504*a* of the arm portion 504 in the longitudinal direction so as to be ratable. At the same time, a portion near the other end portion 504*c* is axially supported on a base portion swinging shaft 504*d* so as to be pivotal about the base portion swinging shaft 504*d*.

In the above arrangement, while the rotating shaft 502 makes one rotation, the slider 503 reciprocates once in the sliding direction. As the slider 503 reciprocates in the sliding direction, one end portion 504*a* of the arm portion 504 vertically moves along the step of the hole portion 503*b*. Along with this movement, the other end portion 504*c* of the arm portion 504 swings.

A cutting blade 506 is exchangeably attached to the other end portion 504*c* of the arm portion 504. A receiving portion 507 is exchangeably attached to the base portion 501 so as to be adjacent to the cutting blade 506 and come into slidable contact with the cutting blade 506 in the feeding direction of a wire. The cutting blade 506 and the receiving portion 507 are made of, for example, a carbide and respectively have groove portions 506*a* and 507*a* each of which has an arcuated cross-section and is open in a downward direction along which a wire is guided. As the arm portion 504 swings relative to the base portion 501, the groove portion 506*a* of the cutting blade 506 moves downward perpendicularly to the feeding direction of a wire relative to the groove portion 507*a* of the receiving portion 507, thus applying shearing force to the wire and cutting it (see FIGS. 11A, 11B, 12A, and 12B).

As shown in FIGS. 4 and 5, the coiling tool units T1 and T2 to bend or wind a wire each have a coiling spindle with a bevel gear being axially supported on one end portion. This bevel gear meshes with the bevel gear 212 of the tool selection table 210 to be rotated/driven.

Letting the bevel gear of the cutting tool unit T0 or the coiling tool unit T1 or T2 mesh with the bevel gear 212 provided on the driving axis D of the tool selection table 210 in this manner makes it possible to drive the tool regardless of the rotational position of the tool selection table 210. The bevel gear 212 is axially supported so as to be rotatable independently of the tool selection table 210 by using the tool driving motor (not shown because it is placed below the laterally driving motor 216) mounted on the rear surface of the laterally moving table 206 as a driving source.

The abutment tools T4 and T5 are fixed to tool support portions 50. The tool support portions 50 are detachably attached to the tool selection table 210. The types and positions of tools can be arbitrarily set.

In this embodiment, the cutting blade 506 is supported so as to be swingable relative to the receiving portion 507 and is placed adjacent to the receiving portion 507 unlike the prior art in which the cutting tool and the wire guide have separate arrangements including the respective driving mechanisms. Moving the cutting blade 506 obliquely downward relative to the receiving portion 507 can obtain larger torque when cutting a wire than in the prior art. This can reduce the deformation and damage of the cutting tool and improve the durability especially when cutting a wire having a diameter of 5 mm or more

[Wire Forming Method]

A wire forming method carried out by the spring manufacturing apparatus according to this embodiment will be described next.

FIGS. 13A to 13C and FIGS. 14A and 14B are perspective views exemplifying a cutting process in the process of formation, which can be carried out by the cutting tool unit according to this embodiment.

In the prior art, a wire can be cut only at the distal end portion of the wire guide, and hence a cutting process is performed only after all processes are complete. In contrast, this embodiment can carry out a cutting process during formation. This will be described in detail below.

First of all, an operator selects a predetermined abutment tool by rotating/driving the tool selection table. The operator then moves the selected tool to a position to face the distal end portion of the wire guide in a spring forming space by moving the tool selection table in a three-dimensional direction by a necessary distance.

Figure 13A:
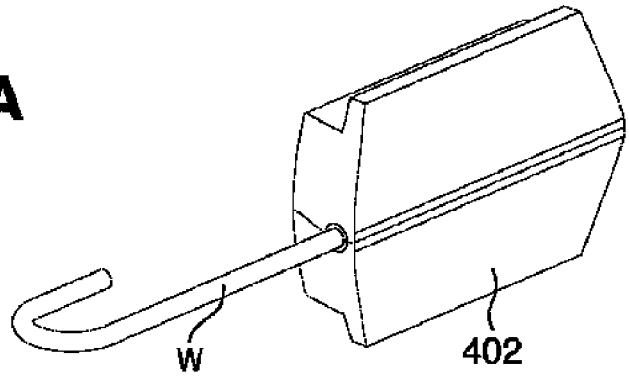
FIGS. 13A to 13C are perspective views exemplifying a cutting process which can be carried out by the cutting tool unit in this embodiment.

The operator feeds out a wire W from the wire guide 402 and presses the wire against the abutment tool to bend the wire (FIG. 13A).

Figure 13B:
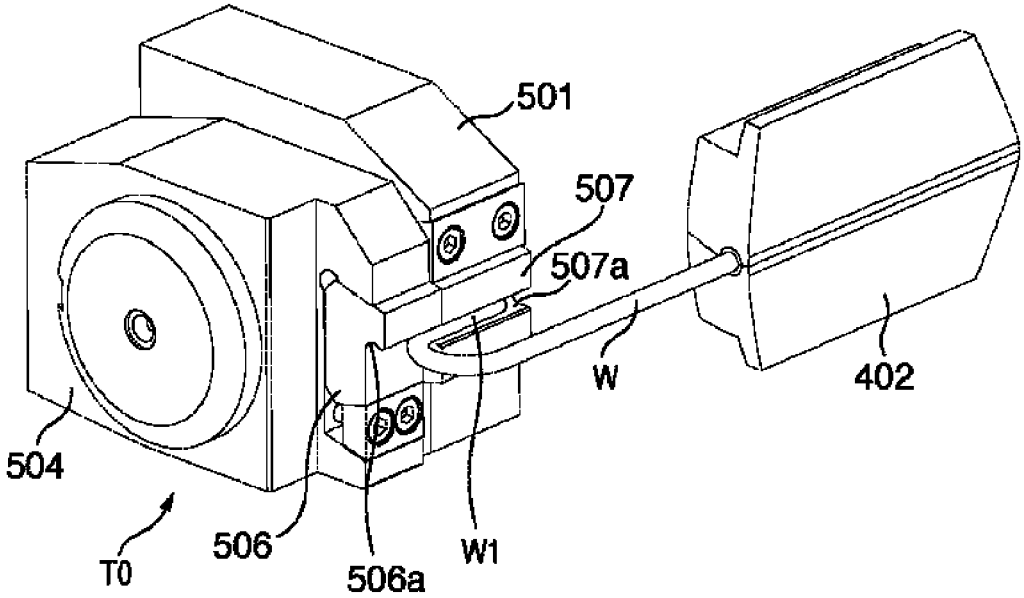
Figure 13C:
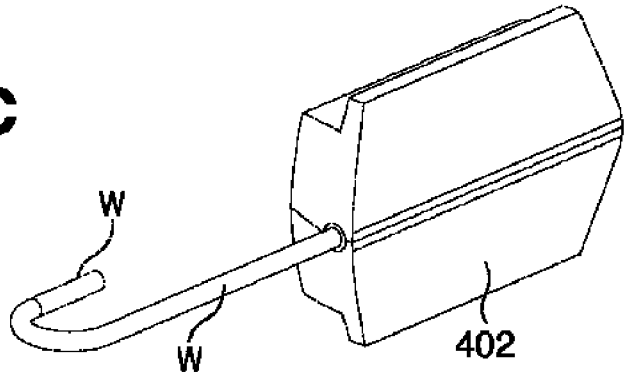

The operator selects the cutting tool unit T0 by rotating/driving the tool selection table, and moves the tool selection table in a three-dimensional direction by a necessary distance to place a bent portion W1 along the cutting blade 506 and the groove portions 506*a* and 507*a* of the receiving portion 507. In this state, the cutting tool unit T0 is driven to cut the bend portion W1 by a predetermined length (FIG. 13B→FIG. 13C).

The operator then selects a predetermined abutment tool by rotating/driving the tool selection table. The operator moves the tool selection table in a three-dimensional direction by a necessary distance to move the selected tool to a position to face the distal end portion of the wire guide 402 in the spring forming space.

Figure 14A:
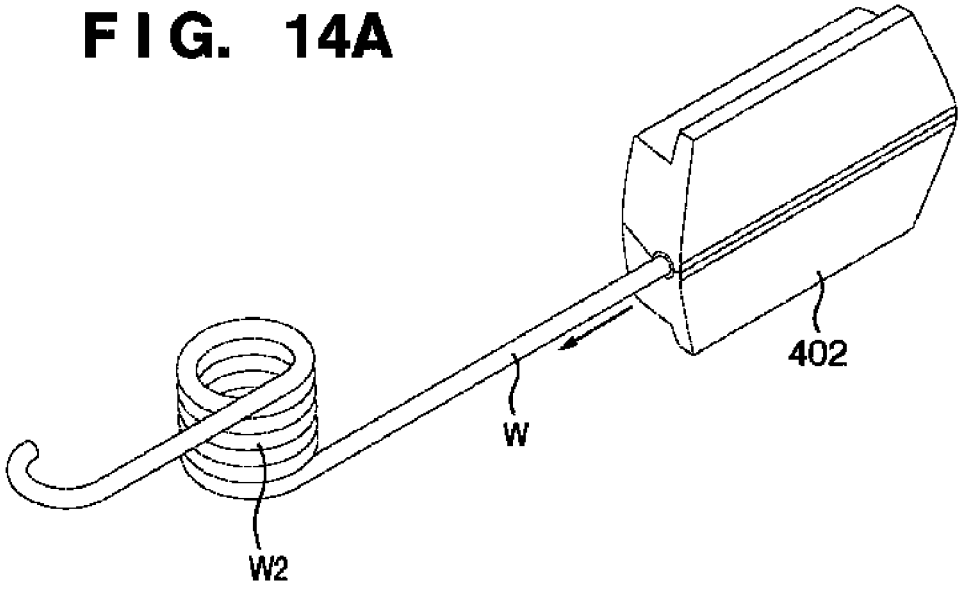
FIGS. 14A and 14B are perspective views exemplifying a cutting process which can be carried out by the cutting tool unit in this embodiment.

The operator brings the wire W into contact with the abutment tool while feeding the wire out from the wire guide 402 to grow a wire portion W2 until it has a predetermined coil length (FIG. 14A).

Figure 14B:
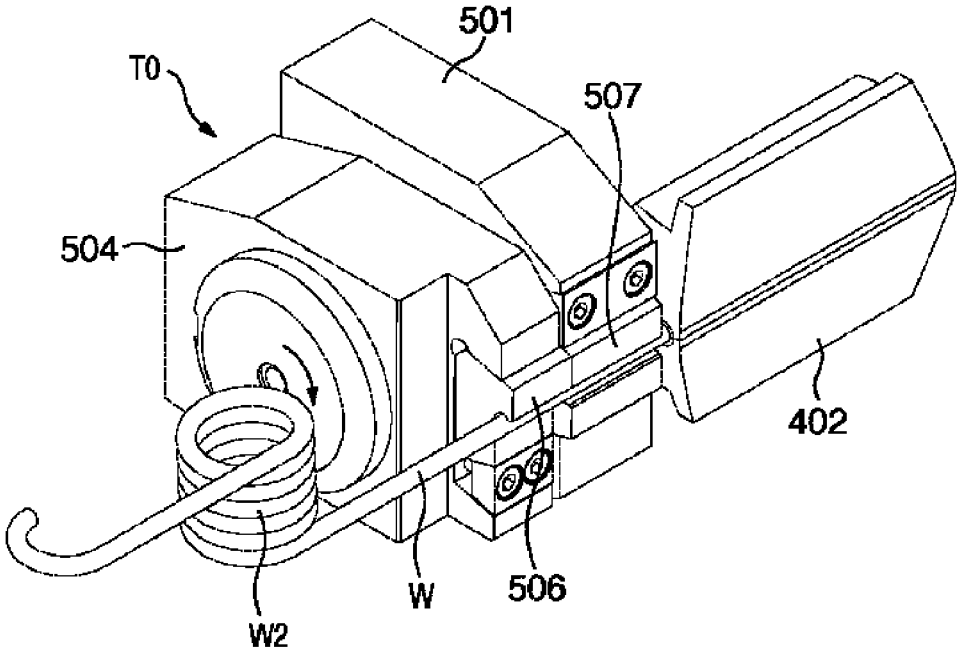

The operator selects the cutting tool unit T0 again by rotating/driving the tool selection table, and moves the tool selection table in a three-dimensional direction by a necessary distance to place a predetermined portion of the wire W extending from the coil portion W2 to the wire guide 402 along the cutting blade 506 and the receiving portion 507. In this state, the wire W is cut by driving the cutting tool unit T0 (FIG. 14B).

As described above, it is possible to carry out a cutting process during spring machining.

Although the above case has exemplified the forming method using one tool selection device, it is possible to perform control to operate the first and second tool selection devices 200 and 300 in synchronism with each other to, for example, make one tool selection device perform a forming process using a forming tool and make the other tool selection device perform a cutting process.

[Arrangement of Controller]

The arrangement of the controller of the spring manufacturing apparatus according to this embodiment will be described next.

Figure 15:
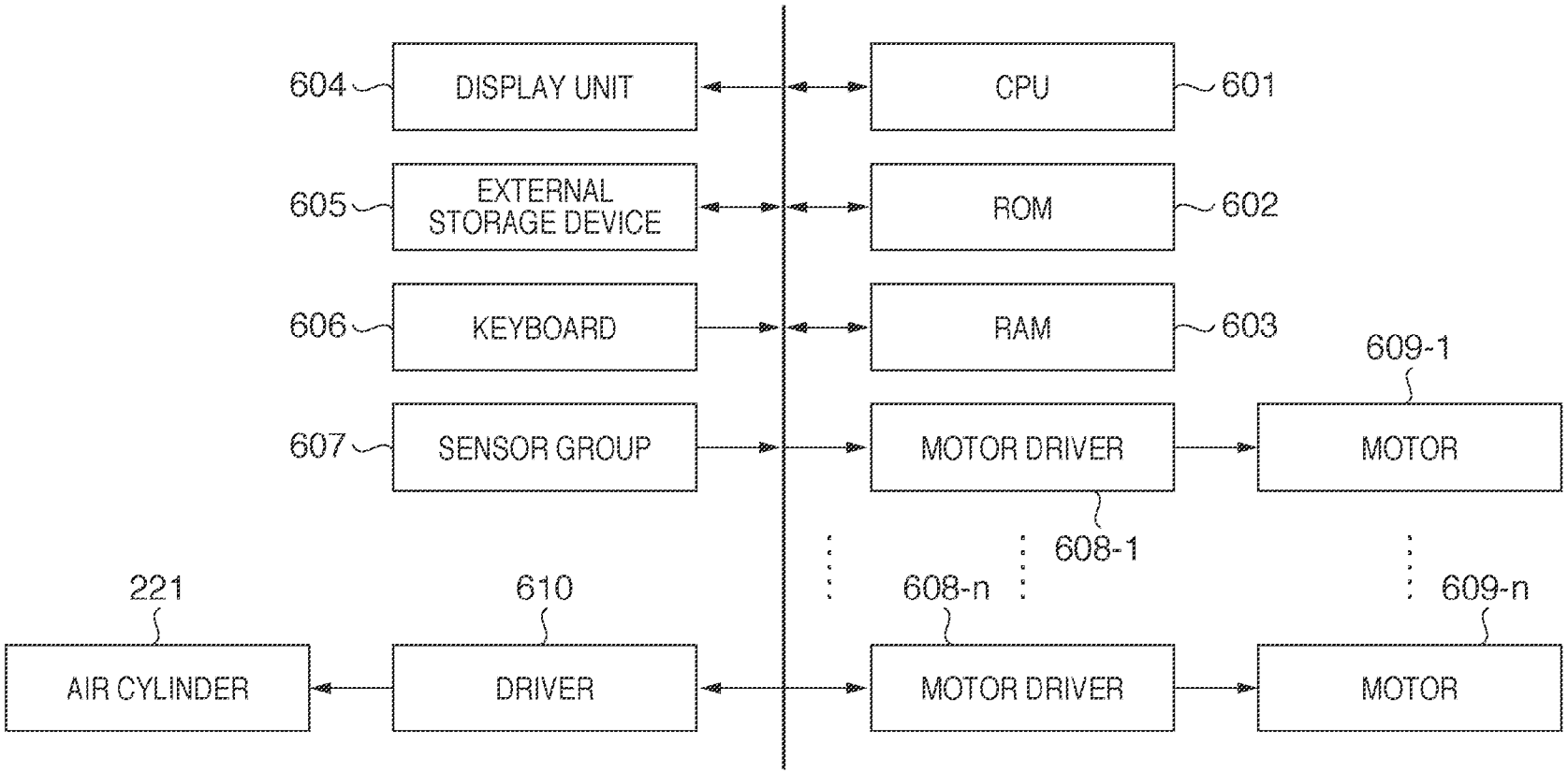
FIG. 15 is a block diagram of a control system for the spring manufacturing apparatus according to this embodiment.

FIG. 15 is a block diagram showing the arrangement of the controller of the spring manufacturing apparatus according to this embodiment. As shown in FIG. 15, a CPU 601 comprehensively controls the overall controller. A ROM 602 stores operation processing contents (programs) of the CPU 601 and various font data. A RAM 603 is used as a work area for the CPU 601. A display unit 604 is provided to perform various settings, display their contents, and display the manufacturing process in the form of a graph. An external storage device 605 is a memory card or the like, which is used to externally supply a program and store the contents of various settings for a wire forming process. Consequently, storing parameters for a given forming process (for example, for a spring, its free length, diameter, and the like) makes it possible to always manufacture springs with the same shape by setting the memory card and executing a forming process.

A keyboard 606 is provided to set various parameters. A sensor group 607 is provided to detect the feed amount of wire, the free length of a spring, and the like.

Motors 608-1 to **608-*n* are equivalent to the table driving motor 211, the back-and-forth driving motor 213, the laterally driving motor 216, the vertically moving motor 218, a tool driving motor 219, the guide driving motor 403, the feed roller driving motor 404, and the feed roller rolling motor 405. Motor drivers 609-1 to 609-*n* respectively corresponding to the motors 608-1 to 608-*n* drive them. A driver 610 which opens and closes an air valve drives the air cylinder 221 of the stopper mechanism 220**.

In this case, for example, the CPU 601 independently drives the respective motors, inputs/outputs data to/from the external storage device 605, and controls the display unit 604 in accordance with instructions input from the keyboard 606.

According to this embodiment, one cutting tool unit T0 and the plurality of types of forming tools T1 to T5 can be selectably mounted on the tool selection tables 210 and 310. This can improve the degree of freedom in selecting a wire cutting process or a cutting portion in the process of formation.

Note that the present invention can be applied to modifications or changes of the above embodiment within the spirit and scope of the invention.

For example, it is possible to singly mount the first and second tool selection devices 200 and 300 and the wire feed device 400 according to this embodiment on different types of spring manufacturing apparatus.

In addition, in this embodiment, it is possible to mount only one of the first and second tool selection devices 200 and 300 on the spring manufacturing apparatus.

The present invention is not limited to the above embodiments and various changes and modifications can be made within the spirit and scope of the present invention. Therefore, to apprise the public of the scope of the present invention the following claims are made.

What is claimed is:

1. A wire forming apparatus which feeds out a wire from a distal end portion of a wire guide, forcibly bends, curves, or winds the wire by using a forming tool in a wire forming space near the distal end portion of the wire guide, and forms the wire into a part with a desired shape by cutting the wire by using a cutting tool, comprising:

a wire feed unit configured to feed out the wire toward the wire forming space;

a tool selection table on which a plurality of forming tools which are different in operation and the cutting tool are detachably and radially arranged, and which rotates about a driving axis defining a predetermined angle with a wire axis to allow selection of a predetermined tool from the plurality of forming tools and the cutting tool;

a selection table driving unit configured to rotate said tool selection table;

a moving table which moves said tool selection table in a three-dimensional direction to position one of a selected forming tool and the cutting tool at a predetermined position in the wire forming space;

a table driving unit configured to move said moving table; a controller which controls said wire feed unit, said selection table driving unit, and said table driving unit in accordance with a procedure for forming the part, wherein a first forming tool in the plurality of forming tools includes a coiling tool of which a coiling spindle rotates about its central axis to wind a wire around the coiling spindle, a coiling tool unit which rotatably supports the coiling tool which winds a wire and a cutting tool unit which supports a cutting blade and a receiving portion to be relatively reciprocal are attached to said tool selection table, a common driving source is provided to apply driving force to the coiling tool unit and the cutting tool unit attached on said tool selection table so as to drive the coiling tool and the cutting tool, wherein the driving source includes a bevel gear which is rotated/driven, the cutting tool unit includes a rotating shaft which meshes with the bevel gear to be rotated/driven, and which has a groove portion formed in an outer circumferential surface so as to be inclined in an axial direction, a base portion which axially supports said rotating shaft and is attached to said tool selection table, a slider which is slidably supported on said base portion and engages with the groove portion of said rotating shaft to convert rotating operation of said rotating shaft into linear operation, and an arm portion which is axially and pivotally supported on said base portion and converts linear operation of said slider into rotating operation about a predetermined rotational axis, and the cutting blade is provided on a distal end portion of the arm portion, and the receiving portion is provided on said base portion so as to be adjacent to the cutting blade.

2. The apparatus according to claim 1, wherein groove portions having arcuated cross-sections which guide a wire and are open downward are respectively formed in the cutting blade and the receiving portion.

3. The apparatus according to claim 1, wherein the moving table includes a back-and-forth moving table which is movable in a back-and-forth direction parallel to the wire axis, a laterally moving table which is movable in a lateral direction perpendicular to the back-and-forth direction, and a vertically moving table which is movable in a vertical direction perpendicular to the back-and-forth direction and the lateral direction.

4. The apparatus according to claim 1, wherein said tool selection table and the moving table are arranged symmetrically about the wire axis.

* * * * *